United States Patent [19]

Duncan et al.

[11] Patent Number: 4,984,998

[45] Date of Patent: Jan. 15, 1991

[54] HIGH DENSITY ELECTRICAL CONNECTOR

[75] Inventors: Frank L. Duncan, Madison; Donald W. K. Hughes, Kernersville; Bobby G. Ward, King, all of N.C.

[73] Assignee: AMP Incorporated, Harrisburg, Pa.

[21] Appl. No.: 450,953

[22] Filed: Dec. 15, 1989

[51] Int. Cl.[5] ..... H01R 13/627

[52] U.S. Cl. ..... 439/352; 439/595; 439/752

[58] Field of Search ..... 439/595, 596, 599, 686, 439/695, 701, 489, 352, 354, 752

[56] References Cited

U.S. PATENT DOCUMENTS

| | | | |
|---|---|---|---|
| 4,013,331 | 3/1977 | Kobler . | |
| 4,588,242 | 5/1986 | McDowell et al. . | |
| 4,634,204 | 1/1987 | Detter et al. . | |
| 4,655,525 | 4/1987 | Hunt, III et al. | 439/599 |
| 4,708,413 | 11/1987 | Schroeder | 439/358 |
| 4,714,433 | 12/1987 | Rider, Jr. | 439/310 |
| 4,722,704 | 2/1988 | Van Der Stuyf et al. | 439/851 |
| 4,746,306 | 5/1988 | Yurtin et al. | 439/357 |
| 4,752,251 | 6/1988 | Kato et al. | 439/752 |
| 4,871,323 | 10/1989 | Ohsumi | 439/188 |
| 4,871,325 | 10/1989 | Maejima et al. | 439/353 |
| 4,891,021 | 1/1990 | Hayes et al. | 439/752 X |
| 4,895,534 | 1/1990 | Klunk et al. | 434/599 |

FOREIGN PATENT DOCUMENTS

| | | | |
|---|---|---|---|
| 0277822 | 8/1988 | European Pat. Off. | 439/595 |
| 2024538 | 1/1980 | United Kingdom . | |

*Primary Examiner*—Neil Abrams
*Assistant Examiner*—Khiem Nguyen
*Attorney, Agent, or Firm*—Robert W. Pitts; Allan B. Osborne

[57] ABSTRACT

High density electrical interconnections are established by using an electrical connector comprising a plurality of terminals held in position by resilient housing latches and by a separate terminal position assurance insert which is formed as part of a one-piece member also having a connector position assurance insert. The terminals position assurance insert is inserted into the housing from the rear and abuts a projection on each terminal thus assuring that the resilient housing latch engages the terminal. A connector position assurance insert attached to the terminal position by a integral strap is inserted beneath a connector latch to prevent the depression of the latch. A strap is deformed so that the connector position assurance insert is located parallel to and adjacent to the terminal position assurance insert when the two are fully seated in the connector. The terminal position assurance insert is inserted immediately adjacent a side wall of the connector housing on which the connector latch is mounted and above a wire crimp and insulation barrel portion to the rear of the projecting section of the terminal. Both the terminal position assurance insert and the connector position assurance insert include laterally deflectable latching springs for retention in the housing.

29 Claims, 12 Drawing Sheets

HIGH DENSITY ELECTRICAL CONNECTOR

BACKGROUND OF THE INVENTION

1. Field of the Invention

This invention relates to an electrical connector and more particularly relates to means for retaining a properly seated terminal within an electrical connector and means for maintaining the electrical connector in a fully mated position relative to a mating connector.

2. Description of the Prior Art

The improper installation of electrical connectors has long been a problem in assemblies containing large numbers of interconnected electrical circuits. Even though the specific electrical connector can perform adequately under normal circumstances, opens can occur when terminals are not properly positioned within electrical connector insulative housing and when mating electrical connectors are not properly mated. In addition to opens which result from improper installation, terminal and connector retention are also important because of the problems that can be encountered over the life of the particular device. For example excessive vibration can cause one connector to become disengaged from another connector. Furthermore, improper retention of contact terminals and connectors can result in unstable electrical interfaces which can result in corrosion thus leading to a gradual deterioration of the electrical interconnection.

A number of steps have been taken to improve the retention of contact terminals within electrical connectors and the mating integrity between two electrical connectors. For example plastic terminal latches or lances which comprise an integral part of an insulative housing are often used to retain terminals within the housing. These plastic terminal latches replace the metal latches on the contact terminals themselves which have been commonly used for a number of years. One problem with these metal latches is that they can easily be overstressed during terminal insertion resulting in significantly reduced in retention of pull-out capability. Furthermore these metal latches have caused problems in the installation of electrical harnesses since the promote tangling of the harnesses. In addition to the use of plastic terminal latches which comprise an integral part of the insulative housing, it is now common practice to use secondary retention members which also lock terminals in place. Typically these secondary locks comprise a separate member which is inserted into the plastic insulative housing and engage a surface on the terminal to provide additional retention. Certain secondary locking members not only independently lock a terminal in position but can only be attached to the electrical connector if the terminal is in the fully inserted position. In addition certain inserts not only independently lock the terminal in place but also move an improperly seated terminal into its fully seated position. These inserts have been referred to as terminal position assurance inserts (TPA). In addition to auxiliary inserts used for terminal position assurance, separate inserts have also been used to hold two mated connectors in engagement. For example U.S. Pat. No. 4,746,306 discloses an electrical connector in which a pin is inserted into engagement with a resilient latch to prevent that resilient latch from becoming dislodged from a mating latch member on a mating connector. Auxiliary devices can be referred to as connector position assurance inserts (CPA). Although CPAs and TPAs do help to assure that a reliable electrical interconnection can be established and maintained, they do represent additional components which must be assembled to the electrical connectors.

At the same time that additional components have been added to electrical connectors to insure that a reliable electrical interconnection is established and is maintained, there has been an increase in the number of electrical circuits which must be fitted within a defined space. This trend has been accelerated by the increasing use of solid state electrical components. U.S. Pat. No. 4,722,704 discloses a high density socket contact receptacle intended for use with a pin header. This electrical connector provides a high density interconnect between wires of a harness and circuits on a printed circuit board. That connector includes both integral plastic latches forming a part of the insulative housing and a separate TPA. No CPA insert is employed.

The instant invention comprises not only high density connector but also employs resilient plastic terminal latches comprising integral part of the instant housing, a TPA insert and CPA insert. Furthermore the instant invention employs a one-piece member which serves both as a TPA insert for one row of terminals and a CPA insert. All this is accomplished in a connector in which adjacent terminals are spaced apart on center lines of 3.0 mm.

SUMMARY OF THE INVENTION

An electrical connector including an insulative housing, a plurality of terminals, a connector latch, a terminal position assurance insert and a connector position assurance is characterized in that the TPA insert and the CPA insert are part of a one-piece member. The TPA insert and the CPA insert are joined by a integral strap and can be mounted in the insulative housing in adjacent parallel relationship by bending the strap.

This connector is also characterized in that both the TPA insert and the CPA insert would have resilient latching springs protruding from the side edges for engagement with the insulative housing. These resilient latching springs on the TPA inserts snap into laterally oriented openings on the rear of the insulative housing. The laterally resilient latching springs on the CPA engage upstanding ribs on the insulative housing which are positioned at the lateral edges of the resilient connector latch which protrudes from one side wall of the insulative housing.

The TPA insert employed in this invention is insertable into a slot at the rear of the housing and abuts an upwardly extending projection on the terminals positioned within cavities in the insulative housing. The projection is bent such that the forward portion of the TPA insert engages a flat side of the projection. In the preferred embodiment of this invention the projections includes inwardly formed ears which overlap the base of the terminal. The flat surfaces on the projection provide a means by which the retention force achievable for these connectors can be significantly increased and consistently reproduced over the life of the tooling used to maunfacture the terminals. In the preferred embodiment of this invention the terminal projection extends above a wire crimp and an insulation barrel on the terminal and the TPA insert is inserted over both the wire crimp and the insulation barrel.

One embodiment of the connector depicted herein employs receptacle terminals while another embodiment employs pin terminals. Like receptacle terminals, the pin terminals include a wire crimp and an insulation barrel with a projection located between the wire crimp and the contact section of the pin terminal. The formed pin protruding from front of this connector can be inserted into an aperture that communicates with the housing in which the connector is positioned. A thin barrier separates this aperture from an opening extending inwardly from the front of this connector, which is formed by a core pin used to form the integrally molded plastic latch for the housing in which the pin terminal is positioned. This latch extends forwardly toward the mating face whereas the latches employed on the insulative housing used with the receptacle terminal comprise part of the exterior side wall of the housing and comprise cantilever latching beams extending rearwardly away from the mating face of the terminal.

BRIEF DESCRIPTION OF THE DRAWING

FIG. 3 is a view similar to FIG. 2 showing the two connectors in mated relationship.

FIG. 13 is a sectional view similar to FIG. 12 in which the two connectors are shown in mated configuration.

DETAILED DESCRIPTION OF THE PREFERRED EMBODIMENTS

Figure 1:
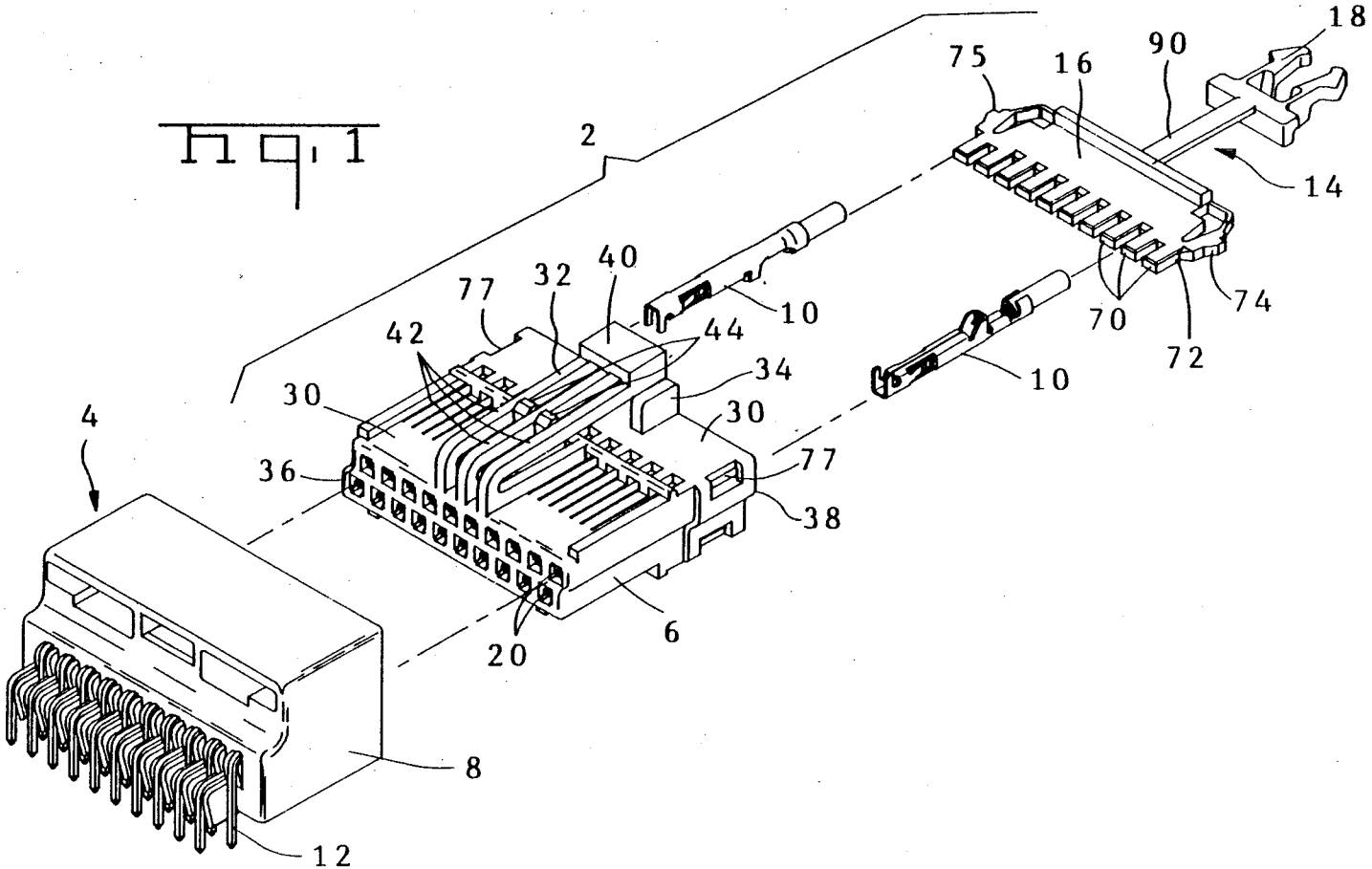
FIG. 1 is an exploded perspective view of the electrical connection comprising the preferred embodiment of this invention which is shown in conjunction with a right angle header.

The electrical connector 2 shown in FIG. 1 is matable with a right angle pin header 4. Electrical connector 2 comprises an insulative housing 6 in which a plurality of terminals 10 are positioned in two parallel rows. The mating pin header 4 also comprises an insulative housing 8 having a plurality of right angle header pins 12. The insulative housing 6 can be fabricated from a conventional engineering plastic such as glass filled LCP. Header housing 8 can also be fabricated from a conventional insulative material such as glass filled PBT. Terminals 10 can be fabricated from a conventional material such a phosphor bronze having a pre tin plating. Header pins 12 can be fabricated using square brass contacts with a tin over nickel plating. The electrical connector 2 also employs a one-piece terminal position and connector position assurance insert 14 which in turn comprises a TPA insert 16 joined to a CPA 18 by an integral strap 90. The TPA and CPA insert 14 can be fabricated from a plastic such as acetal. In the embodiment shown in FIG. 1, the TPA and CPA insert 14 is used in combination with a separate TPA insert of the same construction as TPA 16 but without the integral CPA 18. The TPA and CPA insert 14 is used in conjunction with terminals 10 mounted in a row of cavities 20 in the housing which is located adjacent an integral connector latch located on one side of the housing. Since the connector has only one connector latch 32, no CPA member is needed in conjunction with the terminals located in the other row of cavities 20 in the insulative housing 6. The connector 2 shown in FIG. 1 comprises a twenty position connector in which ten cavities 20 are located in each of two rows. It should be understood that electrical connectors having either a larger or smaller number of terminal positions can be fabricated in the same manner.

The plurality of cavities 20 in the insulative housing 6 extend from the mating end or mating face 36 to the rear face 38 of the insulative housing 6. Individual cavities 20 are positioned side-by-side in two parallel rows. Cavities in separate rows are offset. In the preferred embodiment of this invention the center line spacing between cavities in the same row is 3.0 mm. Therefore the lateral spacing between adjacent cavities 20 in separate rows in 1.5 mm. Although the instant invention is particularly suited for use in a high density connector having terminals spaced apart on center lines of this order of magnitude, it could clearly be employed on larger connectors having less density and one of ordinary skill in the art would appreciate the similar configuration could be employed on smaller center line spacing.

The primary retention member holding terminals 10 within their respective cavities 20 comprises a molded resilient housing latch in the form of a cantilever latch beam 22 which comprises a part of each cavity 20. These molded cantilever latch beams 22 comprise an integral part of one side wall 30 of the insulative housing 6. These latches 22 extend rearwardly from the mating end 36 toward the rear face 38. Each latch 22 includes a latching projection 24 located on the free end of the cantilever latch beam which protrudes into the corresponding cavity 20. These cantilever latch beams 22 extend rearwardly to prevent terminals 10 from being withdrawn through the rear face 38 of the housing 6. Thus these cantilever latch beams are loaded only in tension and need not withstand any significant compressive load. Latches 22 which form a part of the insulative housing side wall 30 are separated by rigid sections of side wall 30 and outward deflection of latches 22 is prevented by a laterally extending overstress rib. Side wall openings are provided to permit access to the free ends 26 of latches 22. Thus the free ends 26 can be deflected outwardly relative to the latch base 28 but such deflection is limited by the laterally extending overstress rib.

Electrical connector 2 is held in mating engagement with the pin header 4 by a connector latch located adjacent side wall 30 on the insulative housing 6. Connector latch 32 comprises an integral part of the insulative housing 6. Connector latch 32 is inwardly depressible to permit a snap engagement of the insulative housing 6 to the header housing 8. Connector latch is also depressible to release the insulative housing 6 from the mating connector housing 8. Connector latch 32 includes a plurality of deflectable beams extending between the rear face 38 and the mating face 36 of the insulative housing. These deflective connector latching beams 42 have a fixed end adjacent to mating face of housing 6 and terminate in a common rear portion 40. This rear portion 40 is positioned between two spaced apart ribs 34 extending upwardly adjacent the rear face 38 of the insulative housing 6. These ribs 34 prevent excessive lateral movement of the connector latch 32. Connector latching shoulders 44 are positioned between adjacent connector latching beams 42 and have a forward inclined surface 46 and a rear vertical surface 48. Forward movement of the insulative housing 6 relative to the header housing 8 brings the forward inclined face 46 of shoulder 44 into engagement with a mating surface 49 thus causing the beams 42 to be inwardly deflected. Continued movement, however, brings the rear vertical face 48 of shoulder 44 into engagement with the mating surface 49 of the mating header housing 8 when the connectors are fully mated. Beams 42 can be cammed inwardly during mating between the two connectors.

Figure 2:
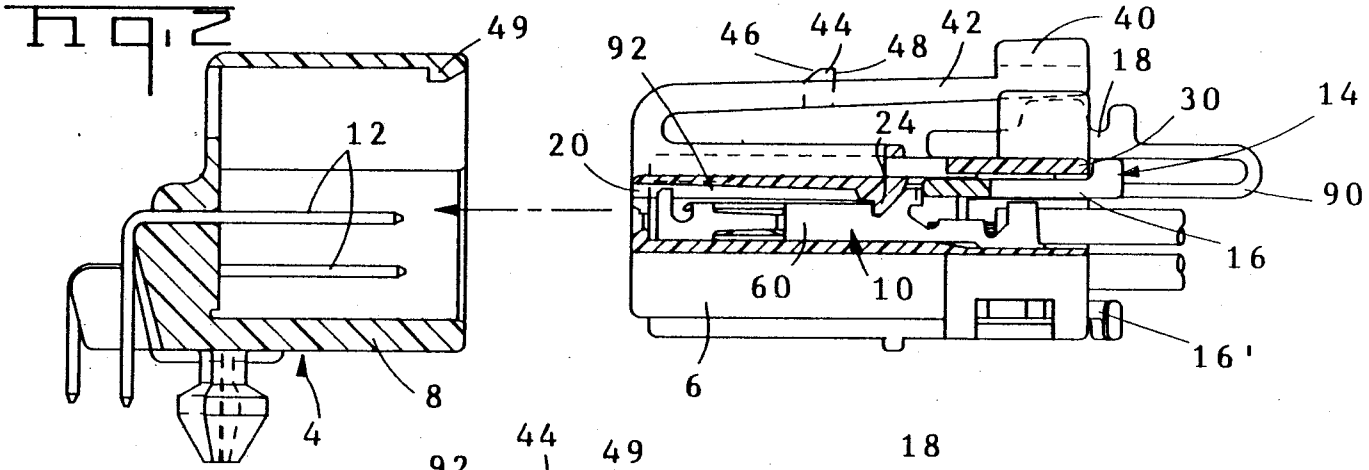
FIG. 2 shows sectional views of the receptacle electrical connector comprising the preferred embodiment of this invention with a right angle pin header.
Figure 1:
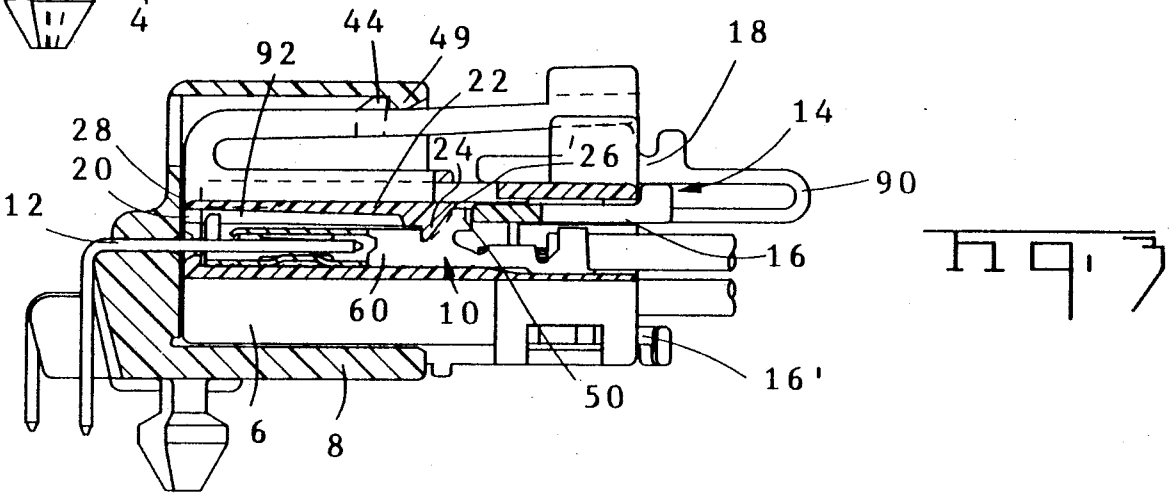
Figure 4:
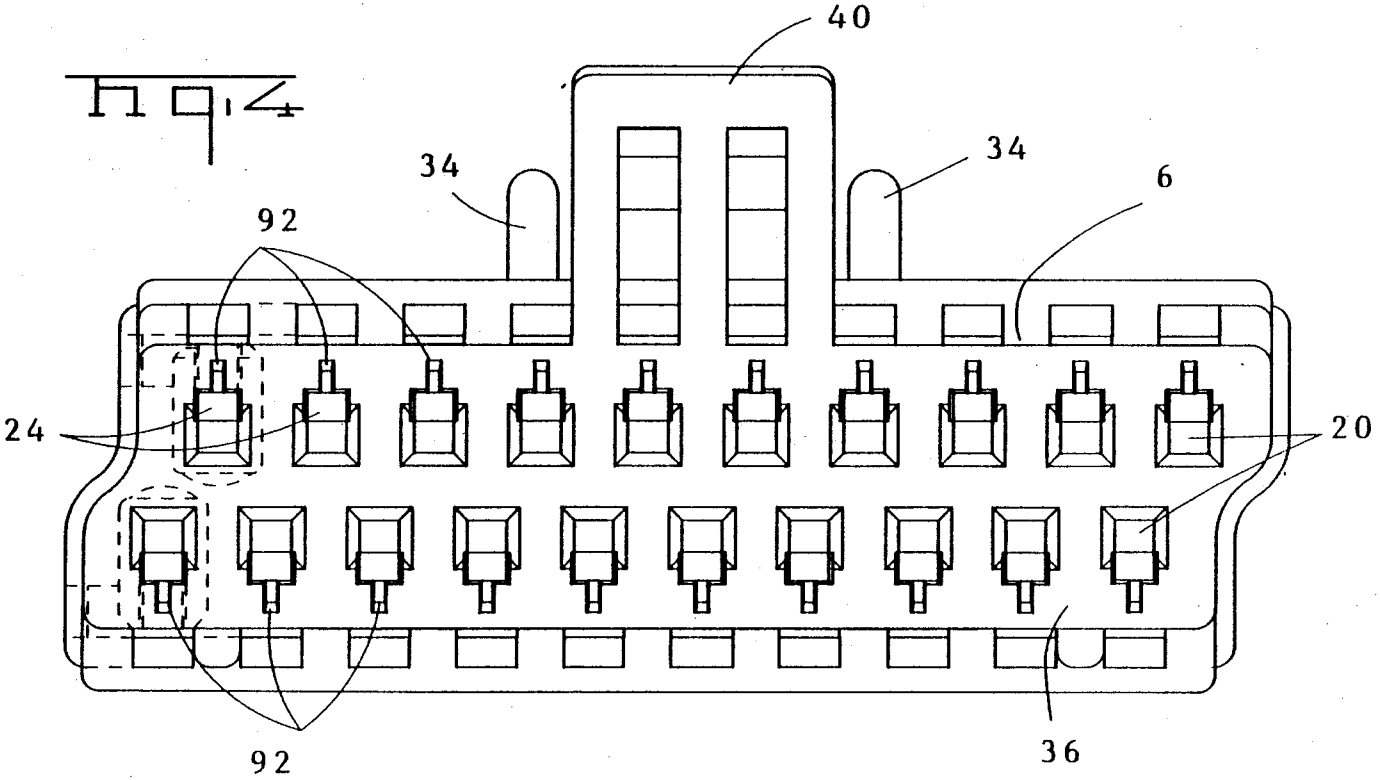
FIG. 4 is a front view of the insulative housing used in the electrical connector which comprises the preferred embodiment of this invention. Hidden lines are shown for one set of the cavities only.
Figure 5:
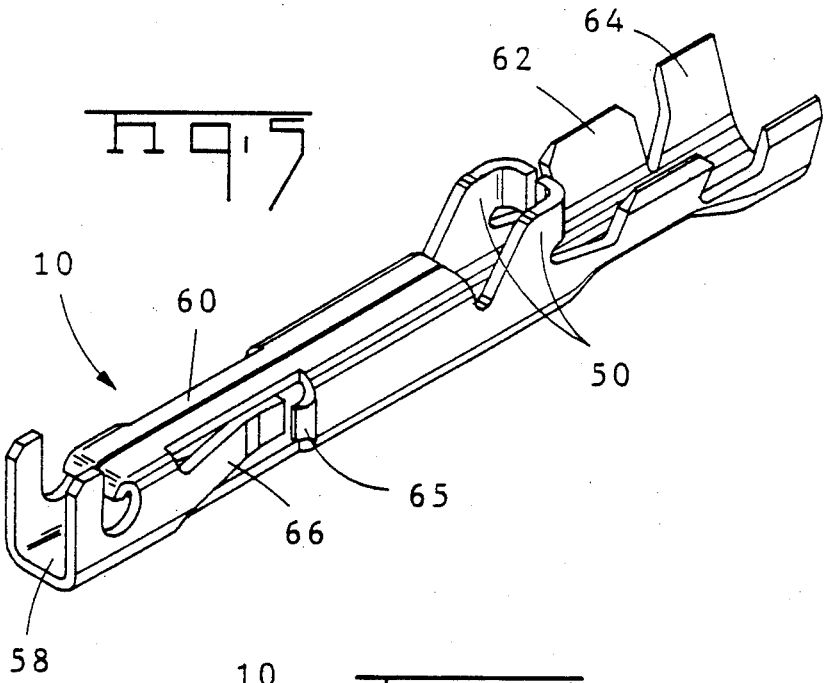
FIG. 5 is a perspective view of a receptacle terminal which can be employed in the electrical connector comprising the preferred embodiment of this invention.
Figure 6:
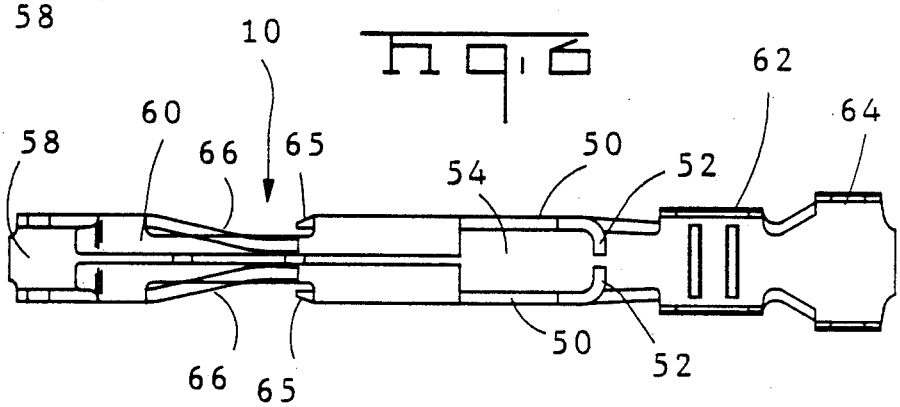
FIG. 6 is a plan view of the terminal shown in FIG. 5.
Figure 7:
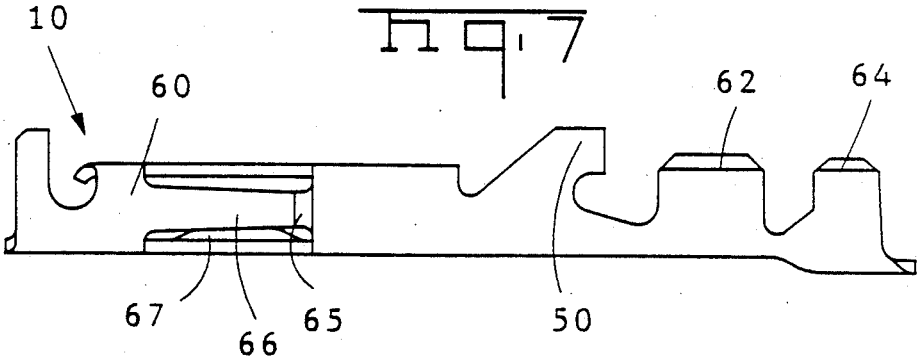
FIG. 7 is a side view of the terminal shown in FIG. 5.
Figure 8:
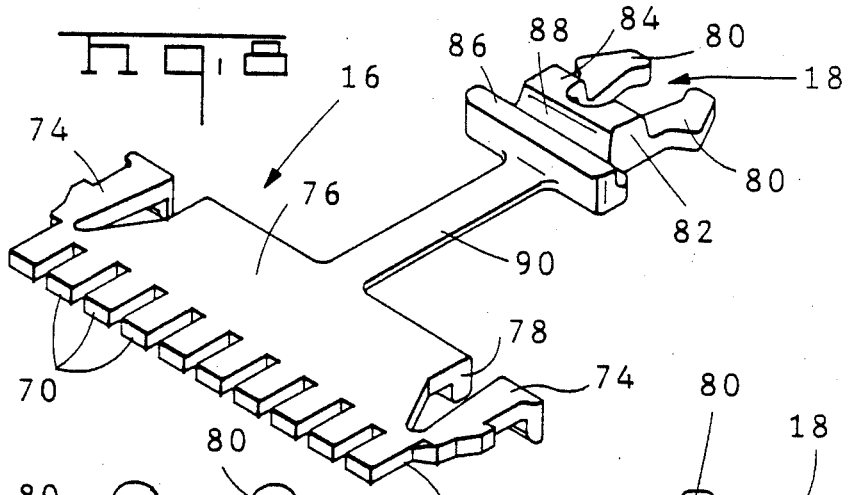
FIG. 8 is a perspective view of the one-piece terminal position and connector position assurance insert.
Figure 9:
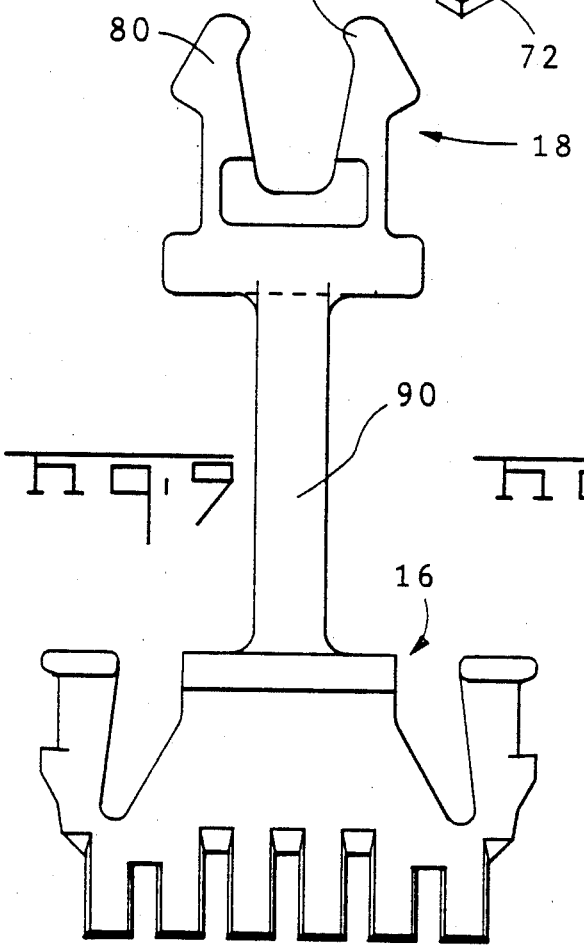
FIG. 9 is a plan view of the terminal position and connector position assurance insert.
Figure 10:
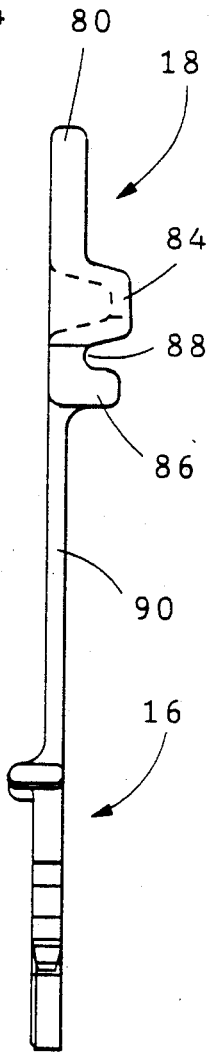
FIG. 10 is a side view of the terminal position and connector position assurance insert.

The receptacle terminals 10 used in electrical connector 2 are shown in more detail in FIGS. 5, 6 and 7. Each of a plurality of these stamped and formed terminals 10 is positioned within an individual cavity 20 in the insulative housing 6. Each terminal includes projections 50 intermediate its opposite ends. Projections 50 extend upwardly from opposite terminal side edges of the base 54. These projections 50 extend upwardly from opposite edges of base 54 in front of a wire crimp 62 and an insulation barrel 64 and between the wire crimp 62 and mating receptacle contact section 60. Projection 50 is bent with a flat side forming an ear 52 extending inwardly on the projection and facing the rear of the terminal 10 above the wire crimp 62 and the insulation barrel 64. Ears 52 overlap the base 54 and are formed so that a flat side of each ear faces the rear of the terminal 10. Wire crimp 62 is a conventional construction and the insulation barrel 64 has a height greater than the wire crimp 62 when each are formed around a wire in the matter depicted in FIG. 1. As shown in FIG. 1, projections 50 and ears 52 are in a position above both the wire crimp 62 and the insulation barrel 64. Ears 52 are formed inwardly so that the free ends 56 of each of the ears 52 are located in opposed relationship. The receptacle contact portion 60 is of generally conventional construction and includes inwardly formed resilient contact springs 66 suitable for establishing electrical continuity with a pin inserted into the receptacle section 60. Anti-overstress protrusions 65 are formed outwardly of the free ends of each contact spring 66 on the sides of a central box section. These anti-overstress protrusions 65 are formed by swaging the sides after the contact springs are formed inwardly. These anti-overstress protrusions prevent plastic deformation of the contact springs 66. A raised section 67 is located along the base of the receptacle contact 60 and is positioned so that a pin, inserted into contact section 60, will rest on the raised section 67 between opposed spring 66. When terminals 10 are inserted into cavities 20 from the rear of the insulative housing 6, resilient housing latches 22 will engage each of the terminals between the projections 50 and the mating end 58 of the terminal. In the preferred embodiment of this invention the latching projection 24 engages the mating receptacle contact portion 60 when the terminal is fully inserted into the corresponding cavity 20. As shown in FIGS. 2 and 3 this latching projection 24 engages the upper edge of the formed over receptacle contact section 60 immediately adjacent the projections 50. Note that the forward edge of projections 50 is included so that the projections 50 extend away from the rearmost projections 24.

The TPA and CPA member 14 is inserted into the insulative housing 6 from the rear. This one-piece member includes a TPA insert 16 in the form of a generally flat member located at one end of a strap 90 and a CPA insert 18 in the form of blocking member located at the opposite end. The TPA 16 is engageable with terminals 10 to hold the terminals in the cavities. TPA 16 is inserted into the insulative housing 6 from the rear. The generally flat TPA insert 16 is inserted into a slot located adjacent to the side wall 30 adjacent to the connector latch 22. This slot is formed by a gap between the side wall 30 and the upper edge of the inner walls which define the respective cavities 20. TPA insert 16 comprises a plurality of fingers 70, each finger being associated with one cavity 20. Each finger engages the rear flat side or ear 52 of the projection 50 on the corresponding terminal 10. If the terminal 10 is not properly in engagement with the terminal latch 22, insertion of the TPA insert 16 will push the respective terminal 10 into its fully seated position. The TPA insert 16 has a generally flat body 76 and the fingers 70 extend from a forward edge of that flat body. A bar 78 extends laterally along the rear edge of the TPA body 76 and forms a stop engageable with the surface on the rear end 38 of the insulative housing 6. The laterally extending TPA bar 78 also provides a means for extracting the TPA insert 16 from its slot in the insulative housing 6.

The slot into which the TPA insert 16 is inserted is located above the position occupied by the wire crimp 62 and the insulation barrel 64. Thus the TPA 16 engages the flat side of ear 52 ahead of the wire crimp 62 and the insulation barrel 64. The TPA 16 also engages the top of the insulation barrel 64 and urges the rear portion of the terminal 10 down against the bottom side of the corresponding cavity 20. Thus lateral movement of the rear of the terminal 10 is restricted. Engagement of the front of finger 72 with the flat ear 52 of projection 50 also increases the retention force supplied by the TPA 16. Retention forces of 30 pounds or more can be achieved using this configuration. A configuration in which the TPA 16 would engage a flat surface instead of an edge of projections increases retention forces from the range of 20 to 25 pounds to the range of 30 to 35 pounds, a significant increase in terms of the performance requirements for this type connector. The TPA 16 is held in the insulative housing 6 by latching springs 24 which protrude from side edges of the TPA 16 to secure the TPA in the housing. These latching springs 24 are inwardly deflectable and include a protruding tooth 75 which is received within a side recess 77 located adjacent the side wall 30 on an edge on the insulative housing 6.

The CPA insert 18 is engageable with the rear portion of 40 of connector latch 32 to hold the latch in engagement with the mating header 4. The CPA 18 prevents the rear portion 40 of the connector latch 32 from being depressed. The resilient beams 42 can, however, be deflected without depressing the rear portion 40 of the connector latch. CPA 18 is inserted between the rear portion 40 of connector latch 32 on the side wall 30 adjacent which the TPA 16 is located. CPA 18 is insertable between the two spaced apart ribs 34 and is thus trapped between these ribs 34, the rear portion 40 of the connector latch 32 and the side wall 30. The height of the CPA body 84 is sufficient to hold the rear portion 40 of connector latch 32 in position. A laterally extending CPA bar 86 is located on the rear of the CPA and is separated from the rest of the CPA body 84 by a lateral recess 88. This lateral recess assists an operator in removing the CPA since it provides a convenient gripping surface. For instance an operator may insert his thumb nail in recess 32 and exert a retraction force on the CPA bar 86 to withdraw the CPA from beneath the rear portion 40 of the connector latch 32. Latching springs 80 engageable with ribs 34 protrude from side edges 82 of the CPA insert 18 to secure the CPA in place. Both the TPA 16 and the CPA 18 have laterally protruding latching springs 24 and 80 respectively and the TPA 16 and the CPA 18 can be positioned side-by-side and substantially parallel to each other by simply bending or deforming the strap 90. This allows the TPA 16 to be inserted on the inside of housing side wall 30 while the CPA 18 is inserted on the outer surface of the side wall 30.

Figure 11:
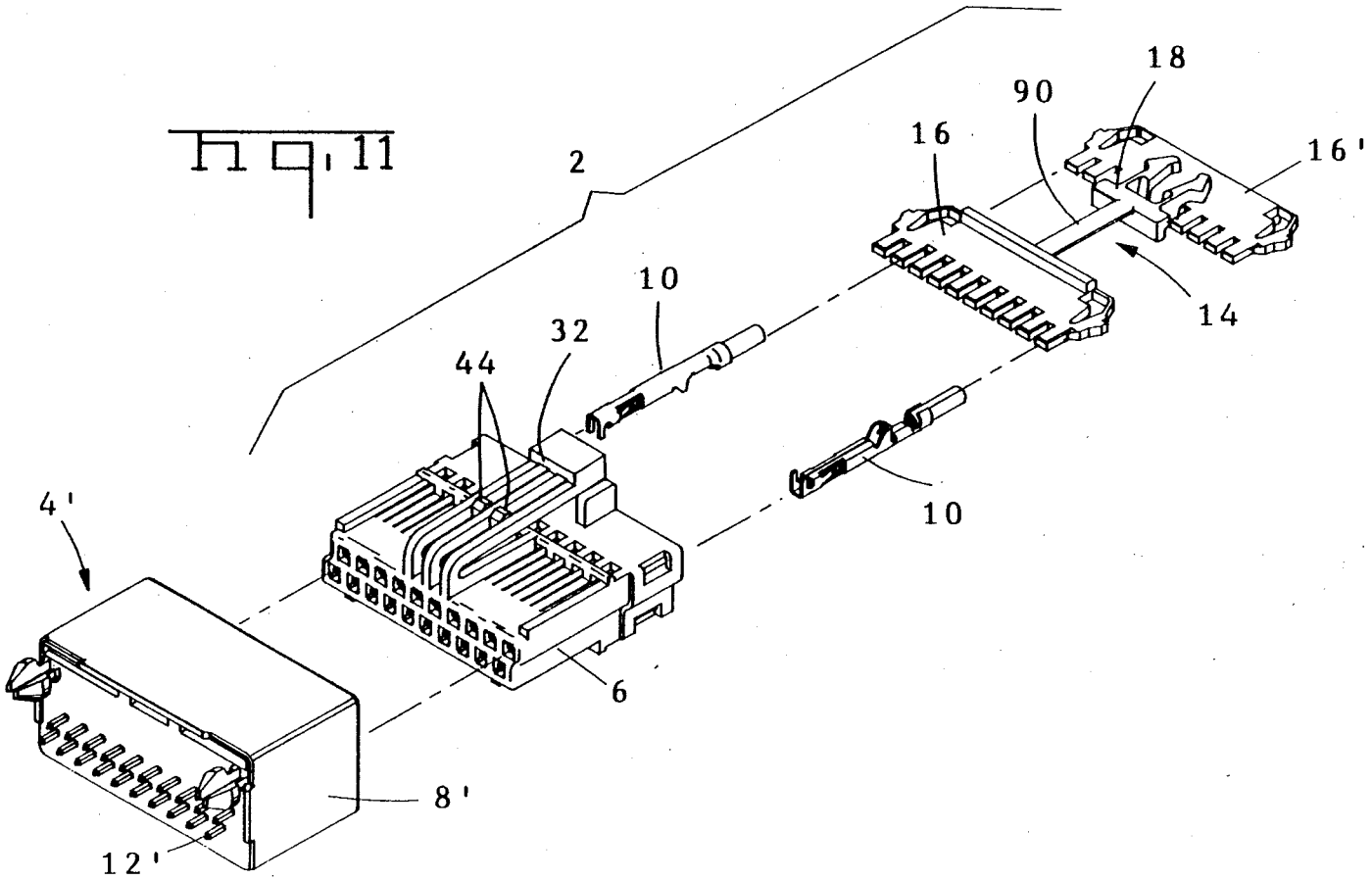
FIG. 11 is an exploded perspective showing the use of the electrical connector comprising the preferred embodiment of this invention with a straight pin header.
Figures 1, 12:
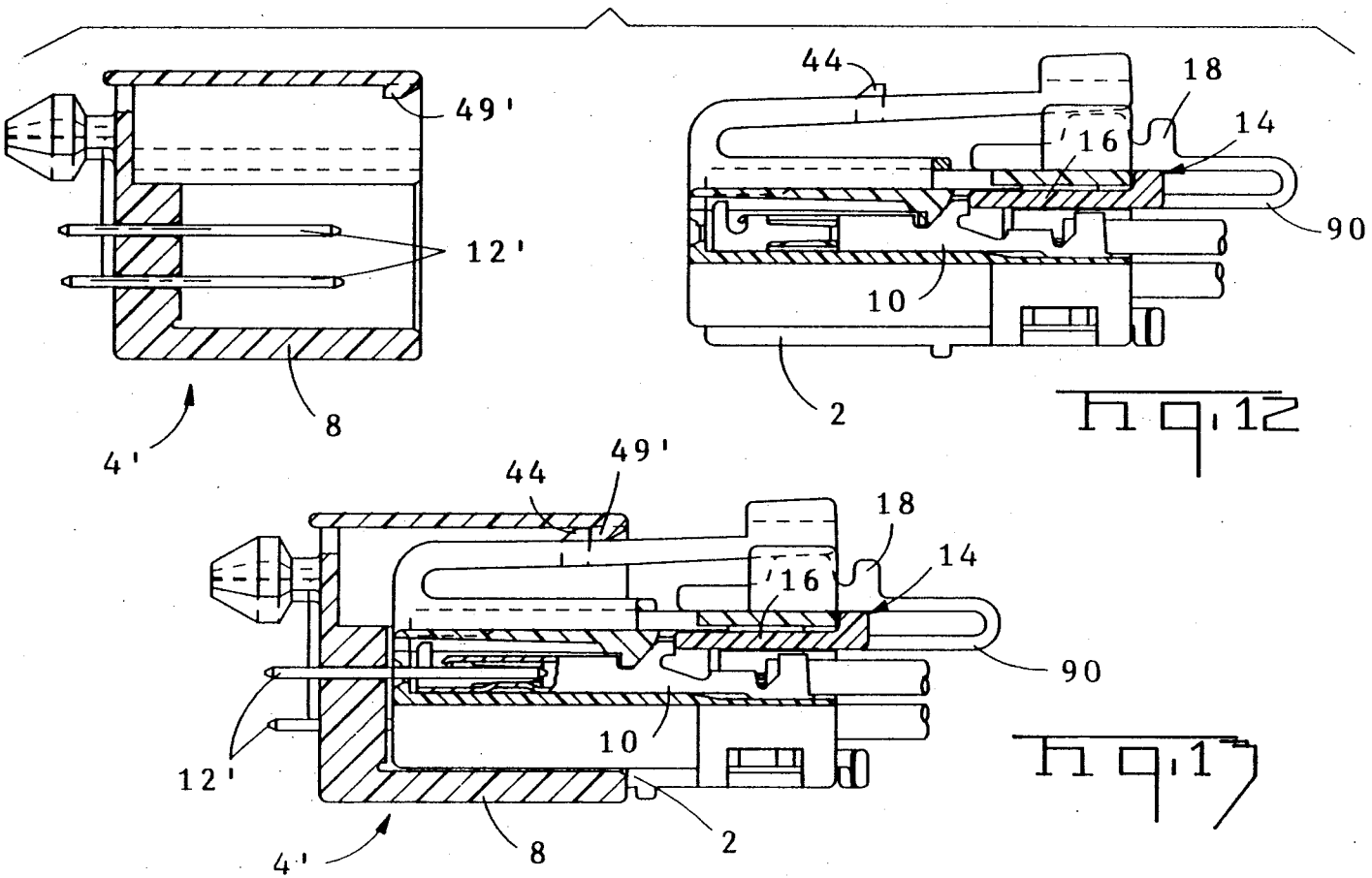
FIG. 12 is a sectional view of the connector assembly shown in FIG. 11.

FIGS. 11 through 13 show the connector 2 as it would be used with an alternate embodiment with a pin header 4'. Pin header 4' has straight pins 12' extending through the rear surface of the header housing 8'. Note that both the alternate embodiment of the header 4' and the preferred embodiment of the right angle header 4 have a central pocket into which pins 12 and 12' extend. The receptacle connector 2 can be inserted into this pocket with the terminals 10 engaging either right angle pins 12 or straight pin 12'. In each case the latching shoulder 44 will engage a mating surface, either 49 or 49', extending into this connector receiving pocket on the header.

Figure 14:
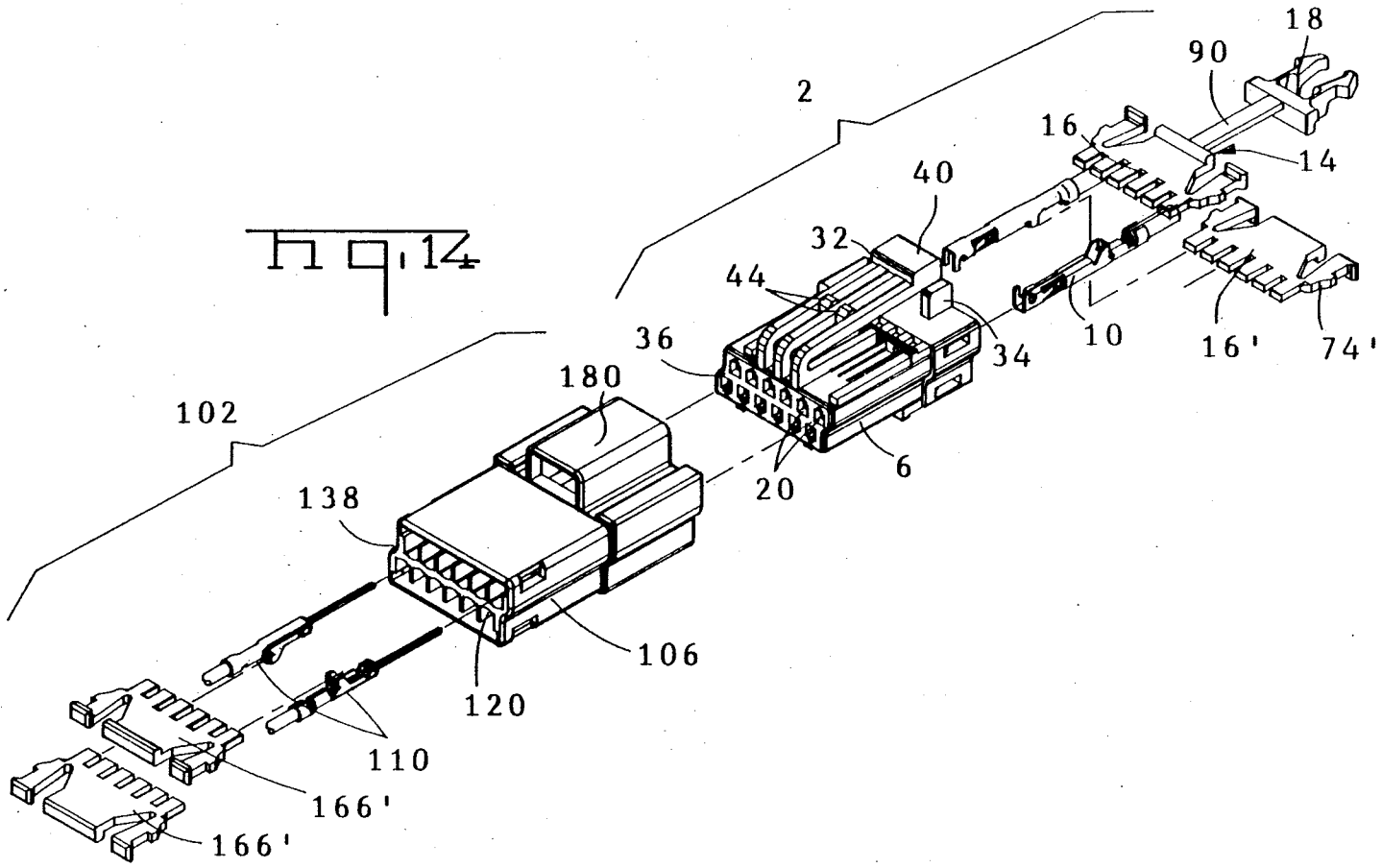
FIG. 14 is an alternate embodiment showing a wire-to-wire connector assembly employing a receptacle connector of the same construction as the preferred embodiment of this invention and a separate mating connector in which pin terminals, attached to separate wires,. are employed.
Figure 15:
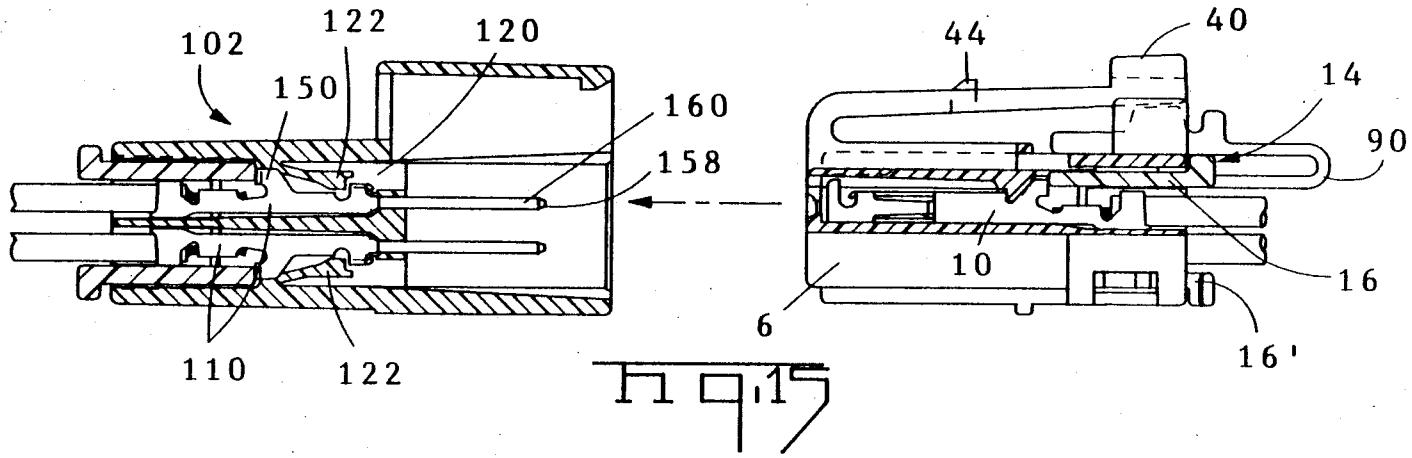
FIG. 15 is a sectional view of the two mating connectors shown in FIG. 14.
Figure 16:
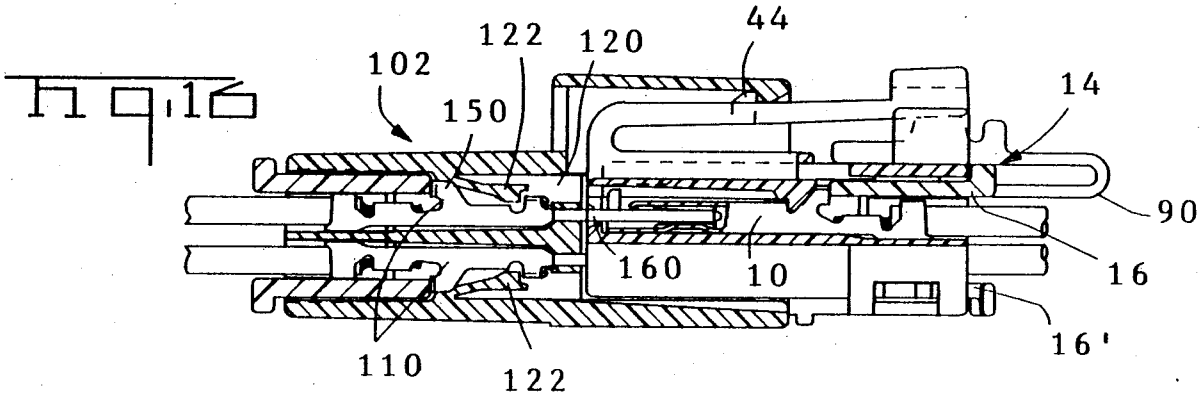
FIG. 16 is a sectional view similar to FIG. 15 in which the two mating connectors are shown in a mated configuration.
Figure 17:
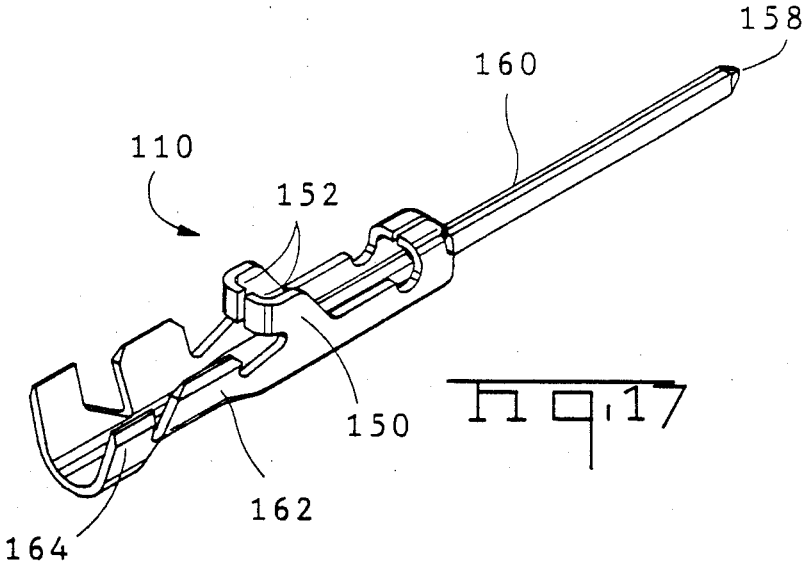
FIG. 17 is a perspective view of the pin terminal.
Figure 18:
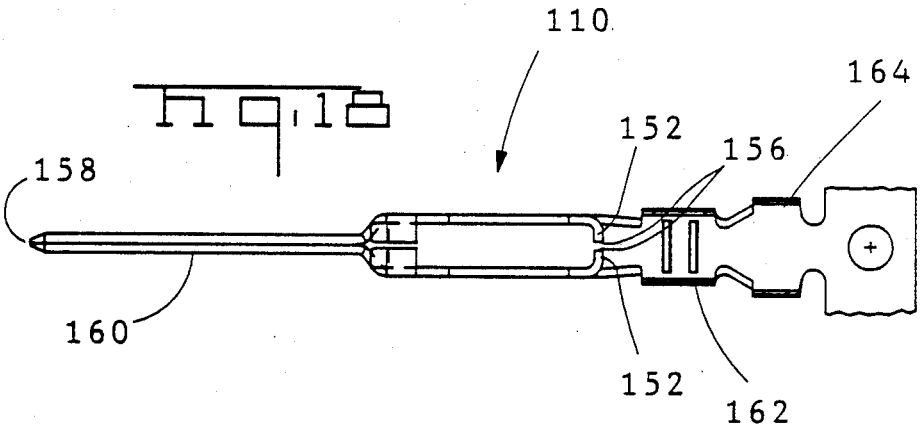
FIG. 18 is a plan view of the pin terminal shown in FIG. 17.
Figure 19:
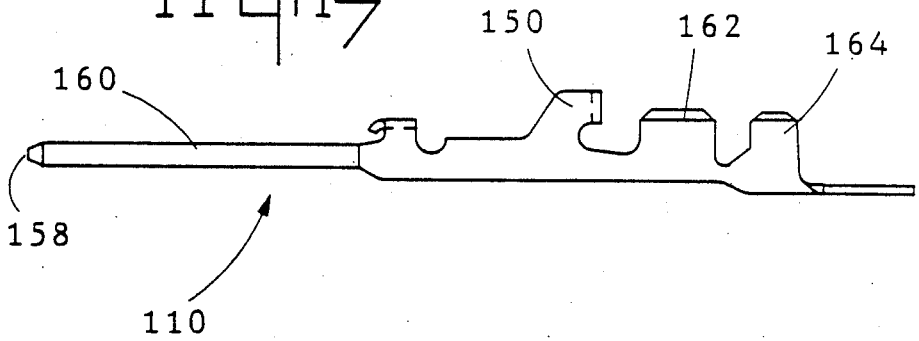
FIG. 19 is a side view of the pin terminal shown in FIG. 17.
Figure 20:
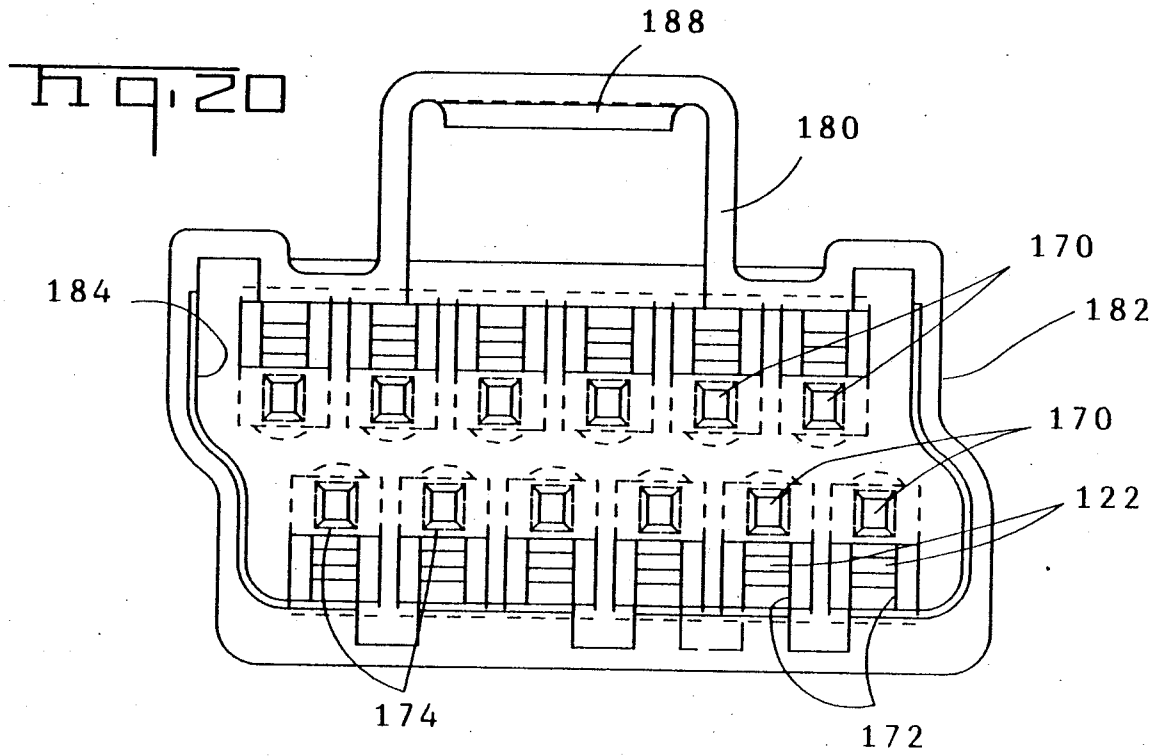
FIG. 20 is a front view of the insulative housing used with the pin terminals.

The embodiments of FIGS. 1 through 13 show a receptacle connector 2 used with a pin header. FIG. 14 discloses an embodiment in which the receptacle connector 2 is used with a separate pin connector 102 to form a wire-to-wire configuration. The embodiment of the receptacle connector 2 depicted in FIGS. 14 through 20 is substantially the same as the receptacle connector 2 depicted in FIGS. 1 through 13. The mating pin connector 102, intended for use with discrete wires, differs from both the electrical connector 2 and the pin header. Electrical connector 102 does have some of the same features as the connector 2. Electrical connector 102 has an insulative housing 106 with a plurality of pin terminals 110 mounted therein. Individual terminal position assurance insert 116', substantially the same as terminal position assurance inserts 16', are employed to retain the pin terminals 110 within the cavities 120 in the pin connector housing 106. The pin terminals 110 can be inserted into cavities 120 in the insulative housing 106 through the rear face 138.

Each of the pin terminals 110 includes a wire crimp section 162 and an insulation barrel 164 identical to wire crimp 62 and insulation barrel 64 on the electrical connector 2. Pin terminals 110 also have a projection 150 identical to projection 50 on terminal 10. The ears 152 on projection 150 fold inwardly over a base 154 and expose a flat side to the rear of the pin terminal 110 in the same fashion as for terminals 10. The contact section of terminal section 110, however, comprises a pin 160 located on the mating end 168 of the terminal. This pin is stamped and formed and is dimensioned for receipt within the receptacle contact portion of terminal 10.

The housing 106 of connector 102 differs significantly from the insulative housing 6 of electrical connector 2. Essentially housing 106 is configured to mate with housing 6. Housing 106 has a plurality of cavities 120 which extend from the rear of the housing 106 to an intermediate section of the housing. A pocket 184 is defined by a shroud 182 is located on the mating end of the housing 106. Pocket 184 is dimensioned to receive the mating end 36 of housing 6. A aperture 170 having an inner dimension smaller than the corresponding cavity is located at the end of each cavity 120 adjacent to the pocket 184. Each aperture communicates with its corresponding aperture and communicates with the common pocket 184. Aperture 170 is dimensioned for receipt of the pin 160 on each terminal 110. The aperture 170 is positioned between the center of the cavity 120 and the inner surface or side of corresponding cavity. Openings 172 are defined adjacent to apertures 170 and are located between the aperture and an outer face or side of the corresponding cavity 120. This opening 172 is aligned with a terminal latch 122 located along the side of the cavity opposite from the inner side. Terminal latches 122 extend inwardly from the outer side wall of the housing cavity and extend toward the mating end of the housing.

The opening 172 is formed by a core pin which is used to mold the forward face of the terminal latch 122. The shape of the opening 172 thus conforms to the outer shape of the core pin and defines clearance for the core pin used to mold the housing terminal latch 122. A thin barrier 174 separates each aperture 170 from the corresponding opening 172. The housing terminal latch 122 is not formed as part of the housing wall in the same manner as the resilient housing latches 22 in connector 2 because of the presence of the pocket 184 adjacent the mating end of connector 102. The pins extending through apertures 170 extend into the pocket 184 which is formed by an outer shroud or wall 182 in a shape corresponding to the shape of the mating end of the connector 2. A latching envelope 186 is formed on one side of the pocket 184 and forms a part of the shroud. This latching envelope is configured to receive the resilient beams 42 on connector latch 32 on connector 2. A mating shoulder is formed on the upper surface of the latching envelope 186. This mating or locking shoulder 188 is configured to engage the latching shoulder 44 on connector 2. Since the pins 160 extend for a substantial distance beyond the apertures 170 into pockets 174, problems attributable to pin misalignment or movement of the pins after mating need to be avoided. These problems are efficiently eliminated by the use of the TPA insert 116' which when positioned above the wire crimp 162 and the insulation barrel 164 engages the top of the insulation 164 to hold the rear end of the terminal down against the inner surface of the cavity 120. Thus the terminal insert 164' serves not only to hold the terminal in the corresponding cavity 120 but also to precisely position the terminal 110 and to restrict the movement of the terminal once it is locked into the housing.

Figure 21:
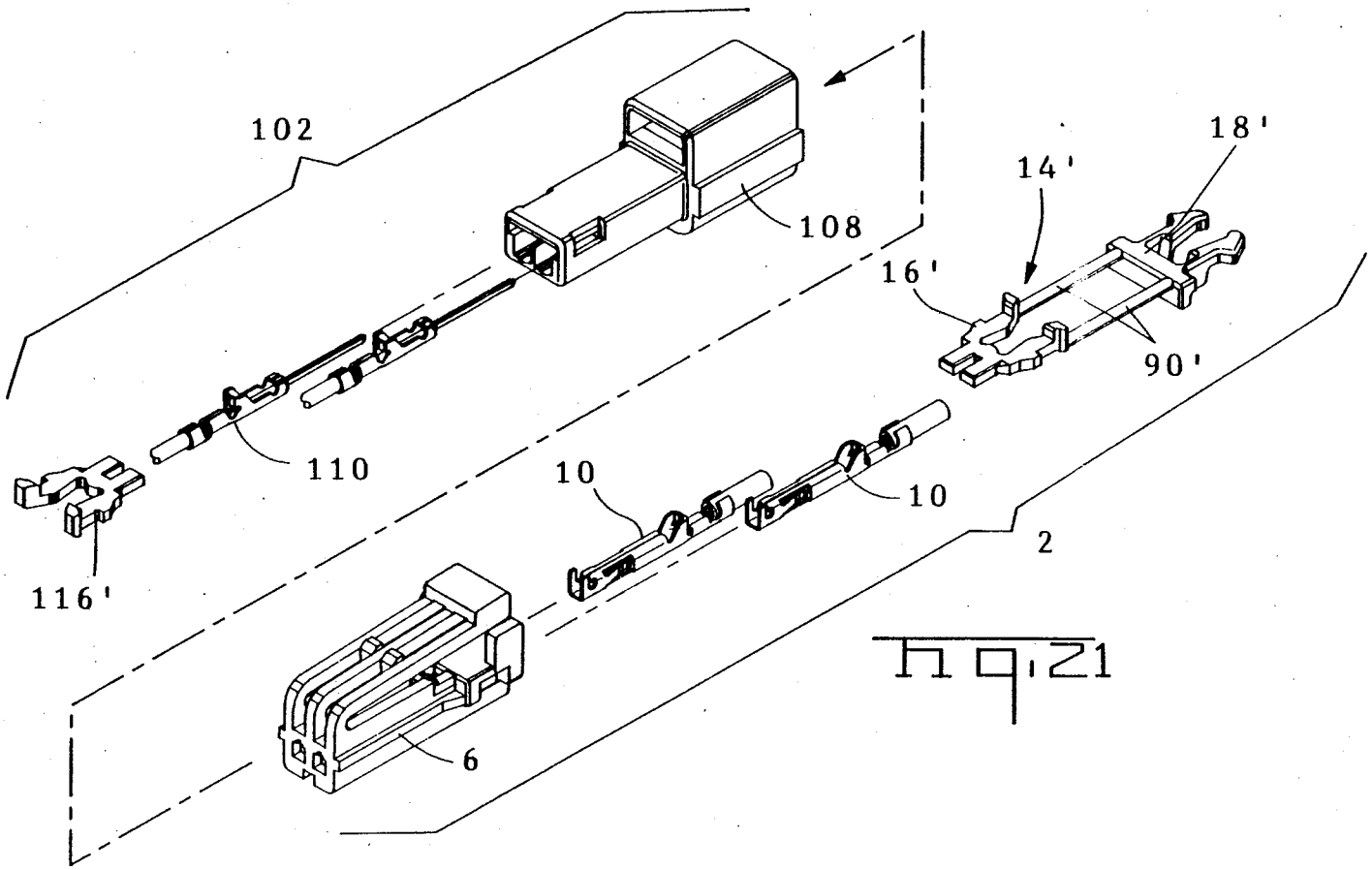
FIG. 21 is an alternate embodiment of the wire-to-wire connector assembly shown in FIG. 14. This embodiment shows a two position connector assembly.

FIG. 21 shows a two position embodiment of the wire-to-wire electrical connector assembly consisting of electrical connector 2 and mating connector 102. The various components of this two position connector are similar to the other connectors. One difference, however, is that the terminal position insert 14' includes two straps 90' adjoining the TPA 16' and the CPA 18'. As shown by the numerous embodiments depicted herein, one of ordinary skill in the art can appreciate that the inventive subject matter disclosed herein can be employed in a number of different configurations. Indeed the basic connector assembly depicted herein is intended to provide a solution to a number of distinct high density applications.

We claim:

1. An electrical connector comprising:

an insulative housing;

a plurality of terminals positioned within the insulative housing;

a connector latch on the insulative housing for latching the insulative housing in mating engagement with a mating connector;

terminal position assurance means engageable with the terminals for holding the terminals in the housing; and connector position assurance means engageable with the connector latch for holding the latch in engagement with the mating connector;

the connector being characterized in that the terminal position assurance means and the connector position assurance means are part of a separate, one piece member.

2. The electrical connector of claim 1 wherein the terminal position assurance means and the connector position assurance means are each positioned on the rear of the insulative housing.

3. The electrical connector of claim 1 wherein the terminal position assurance means comprises a generally flat member insertable into slot means extending into the rear of the insulative housing.

4. The electrical connector of claim 1 wherein the connector latch is depressible to release the insulative housing from the mating connector and the connector position assurance means comprises a blocking member insertable beneath a portion of the connector latch to prevent depression of said portion of the connector latch.

5. The electrical connector of claim 4 wherein said portion of the connector latch comprises a rear portion of the connector latch, the connector latch including at least one deflectable beam extending from said rear portion toward the mating end of the insulative housing, the connector latch further including a shoulder having a forward inclined face and a rear vertical face, each beam being cammed downwardly during mating of the electrical connector with the mating electrical connector, the vertical face engaging a mating surface on the mating connector when the electrical connector is properly mated with the mating connector, no portion of the connector latch being depressible when the vertical face is in engagement with the mating surface and the connector position assurance means is positioned beneath the rear portion of the connector latch.

6. The electrical connector of claim 1 wherein both the terminal position assurance means and the connector position assurance means include latching springs for securement to the insulative housing, the latching springs protruding from side edges of the terminal position assurance means and the connector position assurance means and being inwardly deflectable.

7. The electrical connector of claim 1 wherein the terminal position assurance means in insertable into slot means adjacent a sidewall of the insulative housing on which the connector latch is located, the connector position assurance means being insertable between the connector latch and said sidewall.

8. The electrical connector of claim 7 wherein the one piece member comprises a molded member, the terminal position assurance means being joined to the connector position assurance means by a strap.

9. The electrical connector of claim 8 wherein the strap is deformable to permit the connector position assurance means to be positioned parallel to and adjacent the terminal position assurance means.

10. The electrical connector of claim 1 wherein a rear portion of the connector latch is positioned between two spaced apart ribs, the connector position assurance means being insertable between the ribs and beneath the rear portion of the connector latch to prevent depression of the latch, the connector position assurance means including laterally resilient latching springs engageable with the ribs to hold the connector position assurance means beneath the rear section of the connector latch.

11. An electrical connector comprising:

an insulative housing;

a plurality of terminals positioned within the insulative housing;

a connector latch on the insulative housing for latching the insulative housing in mating engagement with a mating connector;

terminal position assurance means engageable with the terminals for holding the terminals in the housing; and connector position assurance means engageable with the connector latch for holding the latch in engagement with the mating connector;

the connector being characterized in that the terminal position assurance means and the connector position assurance means each include laterally protruding resilient latching springs for engagement with the insulative housing, the insulative housing receiving in side by side relation the terminal position assurance means and the connector position assurance means.

12. The electrical connector of claim 11 wherein the housing includes a slot in the rear of the housing adjacent a sidewall along which the connector latch extends, the terminal position assurance means being insertable into the slot.

13. The electrical connector of claim 12 wherein the connector position assurance means is positioned beneath a rear portion of the connector latch to prevent depression of the connector latch.

14. The electrical connector of claim 13 wherein a rear portion of the connector latch is positioned between two spaced ribs extending from the housing, the connector position assurance means being insertable between the ribs, the laterally resilient latching springs engaging the ribs to hold the connector position assurance means beneath the rear section of the connector latch.

15. An electrical connector comprising:

an insulative housing;

a plurality of stamped and formed terminals positioned within the insulative housing, each terminal including a wire crimp, an insulation barrel having a height greater than the wire crimp and a projection in front of the wire crimp and the insulation barrel, the projection extending above the wire crimp and the insulation barrel;

terminal position assurance means insertable into the rear of the insulative housing over the wire crimp and the insulation barrel to engage the terminals to hold the terminals in the housing, the terminal position assurance means abutting the at least one projection on each terminal to hold said terminal in the housing;

the connector being characterized in that each projection is bent inwardly towards the other with a flat side facing the rear of the terminal above the wire crimp and the insulation barrel, the terminal position assurance means engaging the flat side of the projection instead of an edge of the projection to increase the retention on the terminal provided by the terminal position assurance means.

16. The electrical connector of claim 15 wherein the housing includes a plurality of cavities, a terminal being positioned within each cavity, the housing also including a latch projecting into each cavity to engage the corresponding terminal in front of the projection.

17. The electrical connector of claim 16 wherein each terminal includes a mating receptacle portion, the latch engaging the mating receptacle portion when the terminal is fully inserted into the corresponding cavity.

18. The electrical connector of claim 15 wherein each terminal includes a mating pin in front of the projection.

19. The electrical connector of claim 15 wherein each projection initially extends from a terminal side edge and includes an ear bent relative to the remainder of the projection so that a flat side of the ear faces the rear of the terminal.

20. An electrical connector comprising:

an insulative housing;

a plurality of stamped and formed terminals positioned within the insulative housing, each terminal including a projection extending upward from a base; and terminal position assurance means engageable with the terminals for holding the terminals in the housing, the terminal position assurance means abutting at least one projection on each terminal to hold said terminal in the housing;

the connector being characterized in that each projection includes an inwardly formed ear overlapping the base, the terminal position assurance means abutting the inwardly formed ear overlapping the base, said projections extend upwardly from opposite sides of the base, inwardly formed ears on opposite projections having opposed free ends and the terminal position assurance means includes at least one finger abutting the projections on each terminal and the connector includes a connector latch on the insulative housing and a connector position assurance means insertable beneath a portion of the connector latch from the rear of the housing.

21. The electrical connector of claim 20 wherein the insulative housing includes a plurality of resilient terminal latches engaging corresponding terminals between the projections and a mating end of each terminal.

22. The electrical connector of claim 21 wherein the terminal position assurance means is insertable from the rear of the insulative housing.

23. The electrical connector of claim 20 wherein the terminal includes a wire crimp and an insulation barrel, each ear projecting above the wire crimp and the insulation barrel, the terminal position assurance means being insertable into the insulative housing above the wire crimp and the insulation barrel.

24. An electrical connector comprising:

an insulative housing having a plurality of cavities with a resilient housing latch protruding into each cavity;

a plurality of stamped and formed terminals positioned within the insulative housing, each terminal including a contact section on the front end, a wire crimp, an insulation barrel having a height greater than the wire crimp and a projection between the wire crimp and the contact section, the projection extending above the wire crimp and the insulation barrel;

terminal position assurance means insertable into the rear of the insulative housing over the wire crimp and the insulation barrel to engage the terminals to hold the terminals in the housing, the terminal position assurance means abutting the projection on each terminal to hold said terminal in the housing;

the connector being characterized in that the terminal contact section comprises a pin and each cavity includes an aperture between the center and a first side of the corresponding cavity through which the pin extends, the resilient housing latch extending into each cavity on a second opposite side and the terminal position assurance means extends into the rear of the cavity along the second side and urges each terminal toward the first side of the corresponding cavity to prevent lateral movement of the pin.

25. The electrical connector of claim 24 wherein each housing latch extends from the second side of the corresponding cavity toward the aperture.

26. The electrical connector of claim 25 wherein the housing includes an opening between the corresponding aperture and the second side of the cavity, the opening providing clearance for a core pin for molding the housing latch, a thin barrier separating the aperture from the opening.

27. The electrical connector of claim 26 wherein the housing has a pocket defined by a shroud into which the pins extend, both the aperture and the opening communicating with the pocket.

28. The electrical connector of claim 27 wherein the cavities are located in first and second rows and a latching envelope formed on the shroud extends above the first row of cavities, the latching envelope being open on opposite ends above the first row and having a locking shoulder above the first row.

29. The electrical connector of claim 24 wherein the terminal position assurance means engages the insulation barrel to urge each terminal toward the first side of the corresponding cavity.

* * * * *